US009803650B2

(12) United States Patent
Wygant

(10) Patent No.: US 9,803,650 B2
(45) Date of Patent: Oct. 31, 2017

(54) SEALING DEVICE

(71) Applicant: HANWHA TECHWIN CO., LTD., Changwon-si (KR)

(72) Inventor: Karl D. Wygant, Houston, TX (US)

(73) Assignee: Hanwha Techwin Co., Ltd., Changwon-Si (KR)

( * ) Notice: Subject to any disclaimer, the term of this patent is extended or adjusted under 35 U.S.C. 154(b) by 310 days.

(21) Appl. No.: 14/532,466

(22) Filed: Nov. 4, 2014

(65) Prior Publication Data

US 2016/0123343 A1 May 5, 2016

(51) Int. Cl.

| | |
|---|---|
| ***F04D 29/16*** | (2006.01) |
| ***F04D 29/42*** | (2006.01) |
| ***F01D 11/02*** | (2006.01) |
| ***F01D 11/08*** | (2006.01) |
| ***F04D 29/52*** | (2006.01) |

(52) U.S. Cl.

CPC ..... *F04D 29/4206* (2013.01); *F01D 11/025* (2013.01); *F01D 11/08* (2013.01); *F04D 29/162* (2013.01); *F04D 29/164* (2013.01); *F04D 29/526* (2013.01); *F05D 2240/307* (2013.01); *F05D 2250/182* (2013.01)

(58) Field of Classification Search

CPC .... F01D 11/025; F04D 29/162; F04D 29/083; F04D 29/4213

See application file for complete search history.

(56) References Cited

U.S. PATENT DOCUMENTS

| | | | | |
|---|---|---|---|---|
| RE28,714 | E | 2/1976 | Ruf | |
| 4,909,707 | A * | 3/1990 | Wauligman | F04D 29/167 277/422 |
| 6,082,964 | A * | 7/2000 | Kuroiwa | F04D 29/167 415/113 |
| 7,963,316 | B2 | 6/2011 | Tokunaga et al. | |
| 2007/0080503 | A1 | 4/2007 | Soda et al. | |
| 2007/0280823 | A1 | 12/2007 | Kanemori | |
| 2013/0154195 | A1* | 6/2013 | Uehara | F01D 11/025 277/418 |

FOREIGN PATENT DOCUMENTS

| | | |
|---|---|---|
| JP | 4456062 B2 | 4/2010 |
| JP | 4784449 B2 | 10/2011 |
| JP | 4938309 B2 | 5/2012 |

* cited by examiner

*Primary Examiner* — Woody Lee, Jr.
*Assistant Examiner* — Sabbir Hasan
(74) *Attorney, Agent, or Firm* — Sughrue Mion, PLLC

(57) ABSTRACT

Provided is a sealing device including: an impeller configured to rotate; a casing including a groove portion in a surface facing the impeller; a floating ring configured to float between the casing and the impeller and configured to be inserted into the groove portion; and a centering ring provided inside the groove portion and provided between the casing and the floating ring.

7 Claims, 2 Drawing Sheets

SEALING DEVICE

BACKGROUND

1. Field

Apparatuses consistent with exemplary embodiments relate to a sealing device, and more particularly, to a sealing device for keeping a fluid from leaking out of an impeller that rotates the fluid in a compressor.

2. Description of the Related Art

To increase pressure of a fluid, the fluid may be accelerated outward by rotating an impeller thereby accelerating the fluid outwards from the center of rotation.

In this regard, abrasion occurs between the impeller and a casing due to the rotation of the impeller, and the fluid may escape to the outside during a process of mixing the fluid and the efficiency of the impeller may be negatively impacted.

SUMMARY

One or more exemplary embodiments include a sealing device.

Additional aspects will be set forth in part in the description which follows and, in part, will be apparent from the description, or may be learned by practice of the presented exemplary embodiments.

According to an aspect of an exemplary embodiment, there is provided a sealing device including: an impeller configured to rotate; a casing including a groove portion in a surface facing the impeller; a floating ring configured to float between the casing and the impeller and configured to be inserted into the groove portion; and a centering ring provided inside the groove portion and provided between the casing and the floating ring.

The centering ring may be elastically deformed in response to the centering ring being pressed by the floating ring against the casing.

The centering ring may include an elastic material.

The centering ring may be a ring having a "C" or "O"-shaped cross-section.

The sealing device may further include a retaining ring coupled to the casing, the retaining ring contacting a surface of the floating ring inserted into the groove portion.

The impeller may include a step surface in a surface facing the floating ring, and the floating ring may include a step portion having a corresponding shape to the step surface in a surface facing the impeller.

The floating ring may include a protruding portion configured to be inserted into the groove portion.

The protruding portion may protrude from a base portion of the floating ring, and the base portion may be configured to contact the impeller.

The sealing device may further include a retaining ring coupled to the casing, the retaining ring contacting a surface of the protruding portion inserted into the groove portion.

The centering ring is configured to contact the casing and the floating ring.

BRIEF DESCRIPTION OF THE DRAWINGS

The above and/or other aspects will become apparent and more readily appreciated from the following description of exemplary embodiments, taken in conjunction with the accompanying drawings in which.

DETAILED DESCRIPTION

Figure 1:
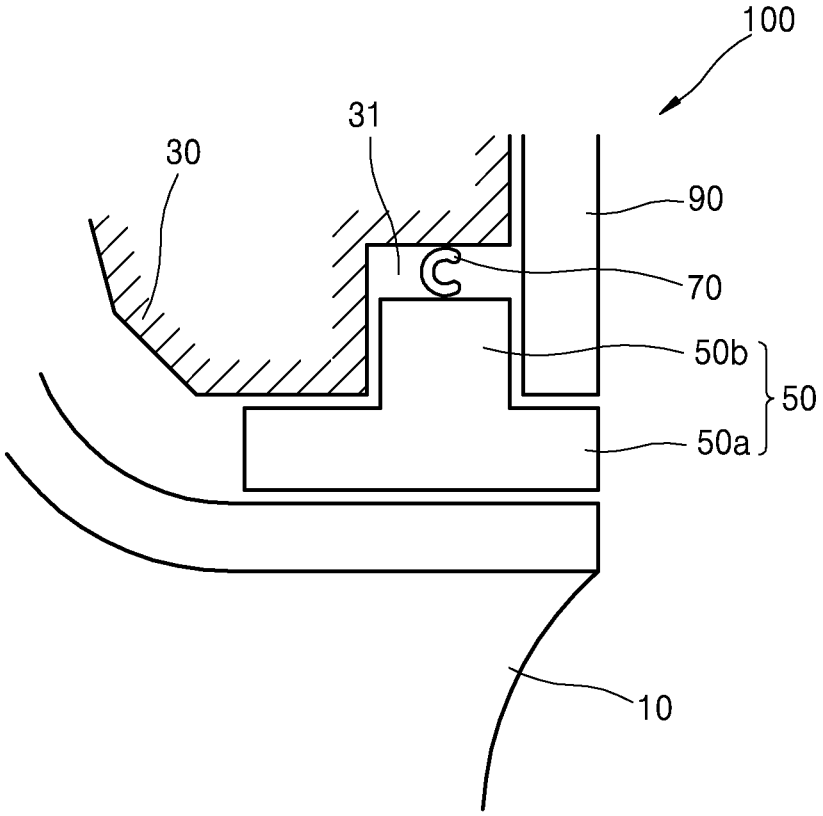
FIG. 1 is a schematic perspective view of a sealing device according to an exemplary embodiment.

As the current inventive concept allows for various changes and numerous exemplary embodiments, particular exemplary embodiments will be illustrated in the drawings and described in detail in the written description. However, this is not intended to limit the inventive concept to particular modes of practice, and it is to be appreciated that all changes, equivalents, and substitutes that do not depart from the spirit and technical scope of the inventive concept are encompassed. Although different exemplary embodiments are illustrated for description of the present invention, like reference numerals in the drawings denote like elements While such terms as "first", "second", etc., may be used to describe various components, such components must not be limited to the above terms. The above terms are used only to distinguish one component from another.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including", "having", and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Hereinafter, the present invention will be described in detail by explaining exemplary embodiments of the invention with reference to the attached drawings.

FIG. 1 is a schematic perspective view of a sealing device 100 according to an exemplary embodiment.

The sealing device 100 according to the exemplary embodiment may include an impeller 10, a casing 30, a floating ring 50, and a centering ring 70.

In the related art, a compressor may include the impeller 10 as an apparatus for drawing in and compressing a fluid and supplying the compressed fluid to another apparatus of the compressor.

The impeller 10 may generally include a hub, a blade, a disk, etc. The blade may be formed in the hub and the disk. In this regard, the impeller 10 may rotate the hub to rotate the blade, draw in the fluid, and eject the fluid to the outside after compressing the fluid.

The impeller 10 is configured to rotatably mix the fluid. The casing 30 is a main body of the sealing device 100 and is provided to contact the impeller 10.

There is a problem that the fluid accelerates due to the rotation of the impeller 10 and escapes from the impeller 10 to the outside when the impeller 10 rotates. The rotation of the impeller 10 may result in abrasion due to friction between the impeller 10 and the casing 30. The abrasion between the impeller and the casing increases an area where the accelerated gas escapes the impeller 10.

The casing 30 may be disposed to contact the impeller 10 and may include a groove portion 31 in a surface facing the impeller 10 as shown in FIG. 1.

The floating ring 50 may be provided to be floating between the casing 30 and the impeller 10. As described above, when the impeller 10 rotates, since the rotation of the impeller 10 may result in abrasion due to friction, the floating ring 50 may float so as to absorb shock and may eliminate abrasion between the impeller 10 and the casing 30.

Further, if the floating ring 50 is not incorporated in a floating state but rather in a fixed state, as the impeller 10 rotates, it is highly likely that the impeller 10 and the floating ring 50 may be abrade against each other due to friction therebetween. As a result, if the impeller 10 and the floating ring 50 are abraded, a gap therebetween increases, which results in increased leakage of the fluid. Therefore, the floating ring 50 should be incorporated in the sealing device 100 to float between the impeller 10 and the casing 30.

The floating ring 50 may be configured to have a shape such that a part of the floating ring 50 is inserted into the groove portion 31. The floating ring 50 includes an unevenness or protruding portion 50*a* protruding from a base portion 50*b* in FIG. 1, but is not limited thereto. The floating ring 50 may have any shapes as long as the protruding portion 50*a* of the floating ring can be inserted into the grove portion 31.

When the groove portion 31 is provided in the casing 30 so that the protruding portion 50*a* of the floating ring 50 is inserted into the groove portion 31, the casing 30 and the impeller 10 may be firmly coupled to each other.

Furthermore, it is effective to prevent the fluid inside the impeller 10 from leaking or escaping simply by placing the floating ring 50 between the casing 30 and the impeller 10.

The sealing device 100 of the exemplary embodiment includes a centering ring 70 that is provided in the groove portion 31 and contacts the casing 30 and the floating ring 50.

That is, as shown in FIG. 1, the centering ring 70 may be provided on the floating ring 50 inserted into the groove portion 31. The centering ring 70 may also be provided to contact a bottom surface of the casing 30 and a top surface of the floating ring 50 that face each other in the groove portion 31.

When the centering ring 70 is provided on the floating ring 50 configured to float such that the floating ring 50 may be floating up and down between the impeller 10 and the casing 30, the centering ring 70 may reduce a shock caused by a collision between the casing 30 and the floating ring 50.

The centering ring 70 may be made of an elastic material. In this case, when the floating ring 50 is floating up and down and presses the centering ring 70, the centering ring 70 may be elastically deformed.

The centering ring 70 is not limited to any materials if the materials are elastic. According to an exemplary embodiments, the centering ring 70 may be configured as a spring or an elastic ring.

As shown in FIG. 1, according to an exemplary embodiment, the centering ring 70 may be configured as a ring having a "C" shaped cross section.

The shape of the centering ring 70 is not limited thereto. In addition to the "C" shape, the centering ring 70 may be configured to have a "O" shaped or another shaped cross section.

According to an exemplary embodiment, the floating ring 50 may be provided to be floating so as to prevent the fluid from leaking out between the casing 30 and the impeller 10, and the centering ring 70 may be provided to be elastically deformed between the floating ring 50 and the casing 30 according to motion of the floating ring 50.

Accordingly, as the impeller 10 rotates, abrasion that occurs between the casing 30 and the floating ring 50 and abrasion between the floating ring 50 and the impeller 10 may be reduced.

As the gap between the casing 30 and the impeller 10 is reduced, the fluid is prevented from leaking to the outside during acceleration of the fluid when the impeller 10 rotates.

The sealing apparatus 100 according to an exemplary embodiment may further include a retaining ring 90 coupled to the casing 30.

The retaining ring 90 may be coupled to the casing 30 such that the retaining ring 90 may contact a surface of the protruding portion 50*a* of the floating ring 50 inserted into the groove portion 31.

As shown in FIG. 1, when the floating ring 50 is configured to have a protruding main portion such that a center part protruding from the base portion 50*b* of the floating ring 50 may be inserted into the groove portion 31, the retaining ring 90 may be provided to contact the floating ring 50 on an edge of the center part of the floating ring 50 that does not contact the casing 30.

That is, the retaining ring 90 may be provided in an opposite side to a surface of the floating ring 50 that may contact the casing 30.

The retaining ring 90 may be provided outside the sealing device 100 so that the centering ring 70 may not escape to the outside and may remain inside the groove portion 31.

The floating ring 50 may be provided to be floating. The centering ring 70 may be also provided to be elastically deformed on the floating ring 50. Accordingly, since the floating ring 50 floats during the rotation of the impeller 10, when the floating ring 50 moves down, a space between the casing 30 and the floating ring 50 increases, and thus the centering ring 70 may escape to the outside. Therefore, when the centering ring 70 is provided, the sealing apparatus 100 may further include the retaining ring 90.

Figure 2:
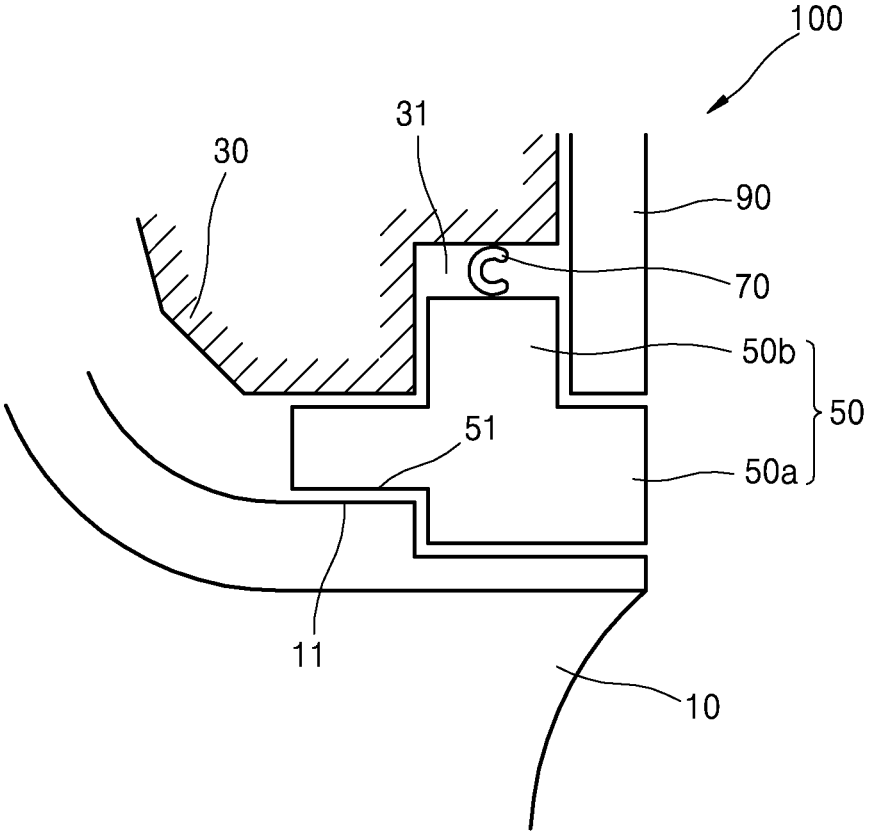
FIG. 2 is a schematic perspective view of a sealing device according to an exemplary embodiment.

FIG. 2 is a schematic perspective view of a sealing device 100 according to an exemplary embodiment.

The sealing device 100 of the exemplary embodiment may include the impeller 10, the casing 30, the floating ring 50, the centering ring 70, and the retaining ring 90 as in the previous exemplary embodiment described with reference to FIG. 1 above.

The casing 30, the centering ring 70, and the retaining ring 90 are the same as those described with reference to FIG. 1 above, and thus descriptions thereof are not provided here for convenience of description.

In FIG. 2, a step surface 11 may be formed on a surface of the impeller 10 that faces the floating ring 50.

Similarly, a step portion 51 having a corresponding shape to that of the step surface 11 may be formed on a bottom surface of the floating ring 50 that faces the impeller 10.

According to the exemplary embodiment, the floating ring 50 is not merely provided on the impeller 10 but the step surface 11 and the step portion 51 are formed, thereby preventing the floating ring 50 from floating right and left, i.e. in a radial direction of the impeller 10, when the impeller 10 rotates.

That is, since the floating ring 50 is configured to float in the radial direction as well as in the axial direction of the impeller 10, the step surface 11 and the step portion 51 may be formed to prevent the floating ring 50 from floating in the radial direction of the impeller and allow the floating ring 50 to float in the axial direction, i.e. up and down direction in FIG. 2.

Accordingly, abrasion that may occur due to the rotation of the impeller 10 may be more efficiently prevented and a fluid may be prevented from leaking to the outside.

The formation of the step surface 11 and the step portion 51 is merely an example embodying the inventive concept of the instant Application. Any forms of the step surface 11 and the step portion 51 may be provided as long as it is possible to prevent the floating ring 50 from floating uncontrollably and efficiently prevent the fluid from escaping.

As described above, according to the one or more of the above exemplary embodiments, an efficiency of preventing a fluid from leaking may be increased.

It should be understood that the exemplary embodiments described therein should be considered in a descriptive sense only and not for purposes of limitation. Descriptions of features or aspects within each exemplary embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the inventive concept as defined by the following claims.

What is claimed is:

1. A sealing device comprising:

an impeller configured to rotate;

a casing configured to contact the impeller and comprising a groove portion on a surface facing the impeller;

a floating ring configured to float between the casing and the impeller, the floating ring comprising a protruding portion configured to be inserted into the groove portion;

a centering ring provided inside the groove portion and provided between the casing and the protruding portions; and a retaining ring coupled to the casing, the retaining ring contacting a surface of the protruding portion inserted into the groove portion, wherein the retaining ring is provided in an opposite side to a surface of the floating ring that contacts the casing, and the retaining ring is provided to cover the groove portion in order that the centering ring remains inside the groove portion.

2. The sealing device of claim 1, wherein the centering ring is configured to be elastically deformed in response to the centering ring being pressed by the floating ring against the casing.

3. The sealing device of claim 2, wherein the centering ring comprises an elastic material.

4. The sealing device of claim 1, wherein the centering ring comprises a ring having a "C" or "O"-shaped cross-section.

5. The sealing device of claim 1, wherein the impeller comprises a step surface on a surface facing the floating ring, and wherein the floating ring comprises a step portion having a corresponding shape of the step surface on a surface facing the impeller.

6. The sealing device of claim 1, wherein the protruding portion protrudes from a base portion of the floating ring, and wherein the base portion is configured to contact the impeller.

7. The sealing device of claim 1, wherein the centering ring is configured to contact the casing and the floating ring.

* * * * *